US012454809B2

(12) United States Patent
Stensdotter et al.

(10) Patent No.: US 12,454,809 B2
(45) Date of Patent: Oct. 28, 2025

(54) MANOEUVRING ARRANGEMENT, AND A METHOD FOR THE MANOEUVRING ARRANGEMENT

(71) Applicant: Hiab AB, Malmö (SE)

(72) Inventors: Maria Stensdotter, Stockholm (SE); Marina Lundgren De Almeida Magalhaes, Stockholm (SE); Helena Vedeler, Bagarmossen (SE)

(73) Assignee: Hiab AB, Malmö (SE)

( * ) Notice: Subject to any disclaimer, the term of this patent is extended or adjusted under 35 U.S.C. 154(b) by 386 days.

(21) Appl. No.: 18/317,394

(22) Filed: May 15, 2023

(65) Prior Publication Data

US 2023/0366173 A1 Nov. 16, 2023

(30) Foreign Application Priority Data

May 16, 2022 (EP) ..... 22173643

(51) Int. Cl.
*E02F 9/20* (2006.01)
*E02F 9/26* (2006.01)

(52) U.S. Cl.
CPC ..... *E02F 9/2012* (2013.01); *E02F 9/26* (2013.01)

(58) Field of Classification Search
CPC ... E02F 9/2012; G06F 3/0482; G06F 3/04892
See application file for complete search history.

(56) References Cited

U.S. PATENT DOCUMENTS 10,996,667 B2 * 5/2021 Bolz ..... G06F 1/163
2008/0154395 A1 * 6/2008 Henriksson ..... B66C 13/56 700/83
2014/0298228 A1 * 10/2014 Meegan ..... G06F 3/0488 715/771
2023/0183942 A1 * 6/2023 Tamura ..... E02F 9/26 715/771

FOREIGN PATENT DOCUMENTS

KR 20160087541 A 7/2016

OTHER PUBLICATIONS

Extended European Search Report issued for priority European Patent Application No. 22173643.2, mailed Nov. 18, 2022.

* cited by examiner

*Primary Examiner* — Mong-Shune Chung
(74) *Attorney, Agent, or Firm* — Renner, Otto, Boisselle & Sklar, LLP.

(57) ABSTRACT

A manoeuvring arrangement for a working equipment, includes a manoeuvring unit and control unit. The manoeuvring arrangement is configured to initiate a selection state in response of a first interaction by an operator with a first selection member. A control unit, when in a selection state, controls a second display section to display a navigation view including a list of a group of a plurality of predefined operation modes. A timer module monitors the time period since the last interaction by the operator with the first selection member and generates an exit selection state signal in response of the monitored time period being larger than a predefined selection time period. The manoeuvring arrangement leaves the operation mode selection state if an exit selection state signal has been generated and initiates the operation mode by applying the operation mode with a marking in the displayed list on the second display section.

15 Claims, 2 Drawing Sheets

MANOEUVRING ARRANGEMENT, AND A METHOD FOR THE MANOEUVRING ARRANGEMENT

This application claims priority of European Patent Application No. 22173643.2 filed May 16, 2022, which is hereby incorporated herein by reference.

TECHNICAL FIELD

The present disclosure relates to a manoeuvring arrangement, and a method for the manoeuvring arrangement. The arrangement comprises a manoeuvring unit intended to receive input from an operator for controlling operations of a working equipment, e.g. a crane.

BACKGROUND

A portable manoeuvring unit is normally used for controlling the functions of a working equipment, such as a hydraulic loader crane, a forestry crane, truck-mounted crane, a hook lift, skip loader, forestry machine or other working equipment mounted to a truck or a vehicle. Presently, these manoeuvring units are normally radio-controlled, enabling the operator of the working equipment, e.g. a loader crane to control and supervise the various operations of the crane from a desired distance and to move freely thereabout. The portable manoeuvring units may also be connected to working equipment by means of a cable in some applications. Further, other wireless communication protocols known in the art may also be used for remote communication between the portable manoeuvring unit and the working equipment.

In order to control a specific operation of e.g. a loader crane, the operator activates one or many control members of the manoeuvring unit. A control member may e.g. be a button, a knob, a joystick or lever. The control members may e.g. be variably operated by being arranged to be spring-loaded in order to return to a neutral starting position when it is not activated. Taking the example of the remote control of a loader crane with hydraulic cylinders as actuators, the remote control is conventionally performed by the manoeuvring unit via an electrical control system regulating an electrical switch attached to a directional vent of a hydraulic system in order to regulate the flow of the hydraulic fluid to a working cylinder of the machine/crane according to the control performed via the control member of the manoeuvring unit. The control member may in this case further be arranged to control the speed of the movement created with the actuator by the displacement of the control member from its neutral position. For a hydraulic cylinder the displacement of the control member may be hence be arranged to control the flow to the hydraulic cylinder.

Similar principles may be applied to control members for working equipment with electrical actuators, where the speed of the movement created by the actuator may be set to be in proportion to the displacement of the control member from its neutral position.

One drawback with conventional manoeuvring units is that due to the increasing number of functions, with the more advanced technologies, configurations and tools available on the working equipment to be controlled and supervised, the control and supervision is becoming increasingly complex and difficult to grasp for the operator. Today, a manoeuvring unit may be capable of controlling up to twenty, or even more, different functions of a working equipment, such as a crane. In the case of a loader crane mounted to a truck this may include semi-automatic and automatic functions, functions related to different working tools and add-ons or accessories as well as truck functionality. Since the number of control members on a portable manoeuvring unit is limited by the size of the manoeuvring unit, the space available on the manoeuvring unit for control members as well as what is manageable for the operator. Looking at the example with the manoeuvring units for cranes there are typically 6-8 control members mapped so that the operator controls 3-4 control members per hand, each control member has to be arranged to be able to control more than one function.

The safety aspects of working equipment are highly prioritized and taking the example of loader cranes there are specific rules in the European Machine Directive, which specify that it must be clear which function(s) that is/are controlled by each control member. Obviously, it is difficult for the operator of a conventional manoeuvring unit, as described above, to grasp which function that is activated, which continued events that will take place during the control of a current function by means of a specific control member, and e.g. to comprehend the meaning of a lightning alert from a light emitting diode. In other words, the complicated design of the conventional manoeuvring unit makes it unmanageable for the operator, and the security aspect may be neglected. An attempt to solve the problem described above involves marking each control member with signs/notes provided with symbols indicating the functions to be controlled by the control member. However, this will not solve the problems described above regarding the efficiency for the operator when managing the manoeuvring unit to access different functions and also the safety related to the management in the human machine interface.

US-2008/0154395 discloses an actuator for controlling and observing functions of a machine, comprising two or more hand-operated control members, functional display elements connected to each control member. Each of the hand-operated control members are arranged to control one or more functions included in different functional groups. This known solution is intended to remove the above stated drawbacks.

However, the conventional manoeuvring unit still requires the operator's visual attention and numerous activation steps in order to select and apply an operation mode with the accessible functions.

Thus, the object of the present invention is to achieve an improved manoeuvring arrangement where the selection of an operation mode to be applied is performed with improved safety, such that the operator may keep more of his/her attention to the area of the working equipment when performing the operation mode selection via the manoeuvring unit.

SUMMARY

The above-mentioned object is achieved by the present invention according to the independent claims.

Preferred embodiments are set forth in the dependent claims.

The difference between the prior art device and the arrangement according to the present invention is that the herein disclosed arrangement offers a selection state for the arrangement where the operator gets an overview of all the available options before choosing a specific option. The selection state is activated by the operator's interaction with a first selection member on the manoeuvring unit. The arrangement provides an interaction scheme presented at a navigation view for the operator of the manoeuvring unit that enables this overview without increasing the number of interactions required, or the number of interaction members needed for the interaction with the operator. The arrangement hence improves the efficiency in the operability and the safety when operating a working equipment with the manoeuvring arrangement.

The manoeuvring arrangement, and the related method, offers the operator an easier task to choose the right operation mode while also keeping the attention to the area of the working equipment from a safety point of view. If there is a need to step through each available option the operator needs to check each interaction/option in the prior art device, whereas the overview in the navigation view enables to check that the correct mode is e.g. three steps away and the operator can then make the correct number of interactions with the selection member without having to look at the navigation view. This is important as this kind of working equipment to be operated is often operated in crowded city environments, like loader cranes used for transport of goods and building material to construction sites.

According to the present invention, a list of selectable operation mode options is presented in the navigation view on a second display section of the manoeuvring unit. The navigation view disappears after a predetermined time period of the last interaction with the selection member, e.g. in the range of 0.4-1.2 seconds, one exemplary setting is 0.7 seconds, and the selected operation mode will then be automatically applied, and an operation view of the selected operation mode will be displayed. Thereby, no separate input from the operator is required, e.g. by pressing a confirmation button, in order to confirm selection of an operator mode.

Furthermore, if the first selection member, e.g. a button, is activated by the operator before the predetermined time period has lapsed, a marking in the navigation view will move to the next shown selectable operation mode.

DETAILED DESCRIPTION

The manoeuvring arrangement, and the method in relation to the arrangement will now be described in detail with references to the appended figures. Throughout the figures the same, or similar, items have the same reference signs. Moreover, the items and the FIGS. are not necessarily to scale, emphasis instead being placed upon illustrating the principles of the invention.

Figure 1:
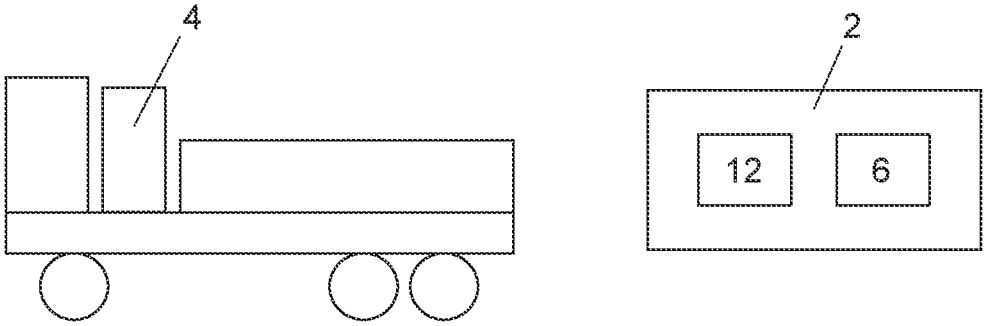
FIG. 1 is a schematic illustration of the manoeuvring arrangement according the present invention applied for controlling a working equipment mounted to a vehicle.
Figure 2:
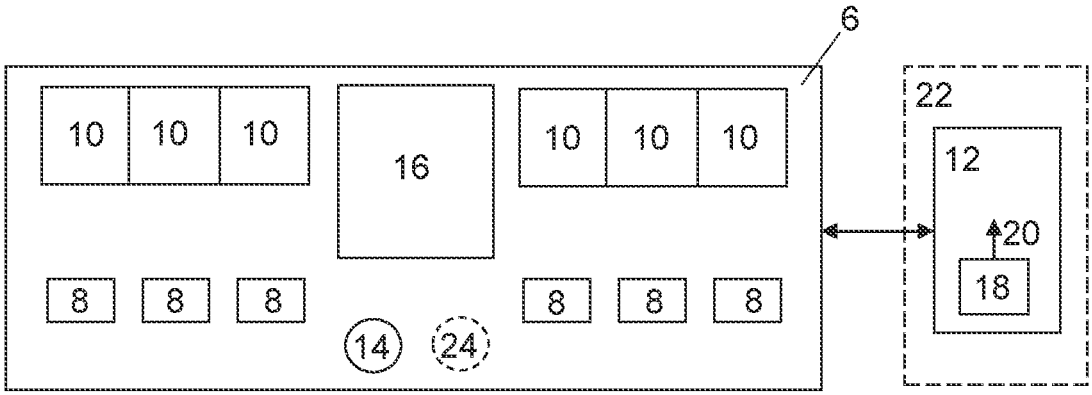
FIG. 2 is a block diagram schematically illustrating manoeuvring arrangement according the present invention.

With references to FIGS. 1 and 2, a manoeuvring arrangement 2 is provided to be used for controlling a working equipment 4, e.g. arranged at a vehicle, such as a truck or a lorry. Various examples of working equipment include cranes, loader cranes, forestry cranes, forestry machines, mining machines, hook-lifts, skip-loaders, demountables, and waste equipment. The working equipment may also be a fixed installation, e.g. cranes mounted on wind turbine plants. In addition, the manoeuvring arrangement 2 may be configured to control more than one working equipment, e.g. a crane and a further working equipment, by applying different operation modes.

The manoeuvring arrangement comprises a manoeuvring unit 6 comprising a set of control members 8 and a first display section 10, and a control unit 12. The manoeuvring unit is a portable unit, normally battery-powered (but may be powered over a cable as an alternative), and ergonomically designed to be easy to use and sized to enable operator activation remote from the working equipment.

The control unit is in wireless and/or wired connection with the manoeuvring unit, and is configured to control an operation of the working equipment in response of operator input from an operator to the manoeuvring unit 6 via the set of control members 8, and to control the first display section 10 to display graphical instructions of a set of available operation functions mapped to the set of control members 8.

The manoeuvring arrangement 2 is configured to operate in one selected operation mode among a plurality of predefined operation modes, where each operation mode is having a predefined set of available operation functions mapped to the set of control members 8.

The manoeuvring unit 6 further comprises a first selection member 14, such as a button, arranged to receive operator input from the operator regarding a selection of one of the operation modes. The manoeuvring unit 6 illustrated in FIG. 2 is provided with six control members, and the first display section 10 is provided with six sub-sections, where each sub-section is positioned above one of the control members, and controlled to display the specific function to be operated by that control member by showing a schematic illustration of the function. In another variation the manoeuvring unit is provided with eight control members, and the corresponding number of first display sub-sections, of course, the arrangement according to the invention may be implemented with other numbers of control members as well.

Figure 3:
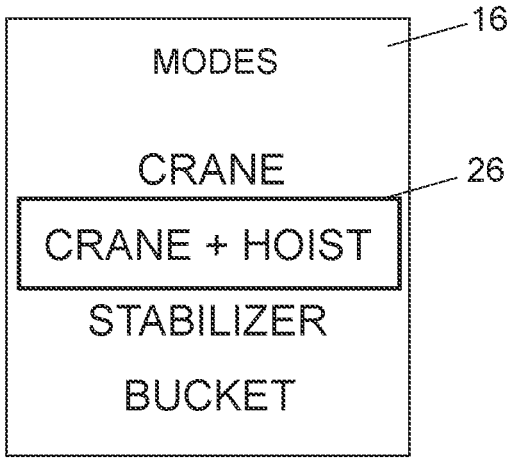
FIG. 3 illustrates an exemplary navigation view shown on the second display section according an embodiment of the present invention.

The manoeuvring arrangement 2 is configured to initiate a selection state in response of a first interaction by the operator with the first selection member 14. The control unit 12 is further configured, when in the selection state, to control a second display section 16 of the manoeuvring unit 6 to display a navigation view comprising a list of at least a group of the plurality of predefined operation modes, e.g. 3-5 operation modes, and to control a marking to sequentially mark the operation modes in the displayed list in response to operator input via further interactions by the operator with the first selection member 14. FIG. 3 illustrates an exemplary navigation view showing a list of four different operation modes where the second operation mode "CRANE+HOIST" is marked as selected which is indicated by a rectangular marking 26.

The manoeuvring arrangement 2 further comprises a timer module 18 arranged to monitor the time period since the last interaction by the operator with the first selection member 14, when in the selection state, and to further generate an exit selection state signal 20 in response of the monitored time period being larger than a predefined selection time period. The control unit 12 is configured to receive the exit selection state signal 20, and wherein the manoeuvring arrangement 2 is further arranged to leave the operation mode selection state and to initiate the operation mode by applying the operation mode with the marking in the displayed list on the second display section 16 being the selected operation mode, in response to the control unit 12 having received the exit selection state signal 20.

In FIG. 2, the timer module 18 is indicated to be arranged in the control unit 12. However, as an alternative variation, the timer module may optionally be arranged as part of a control system 22 of the working equipment, and that in turn includes the control unit 12, or the timer module 18 may be arranged in the manoeuvring unit 6.

The control unit 12 may be part of the control system 22 arranged on the working equipment, and wherein the manoeuvring unit is configured to transmit signals representing the operator input from an operator to the manoeuvring unit to the control system 22 of the working equipment via a wired and/or wireless connection. Preferably, the control system 22 of the working equipment is configured to transmit signals representing input to the first and second display sections. The control unit 12 controls what is displayed on the first and second display section of the manoeuvring unit 6 by transmitting control signals to the manoeuvring unit 6.

According to an embodiment, the control unit 12 is further configured to control the first display section 10 to display graphical instructions of the set of available operation functions mapped to the set of control members 8, corresponding to the initiated operation mode in response to leaving the operation mode selection state.

According to another embodiment, the control unit 12 is further configured to control the first display section 10 to display graphical instructions of the set of available operation functions mapped to the set of control members 8, corresponding to the marked operation mode in response to operator input via further interactions by the operator with the first selection member 14. This may be advantageous as the operator then already in the selection view may identify the available operation functions mapping to the marked operation mode.

According to another embodiment, the marking of an operator mode in the displayed list on the second display section 16 comprises a graphical symbol, such as a star, a border, a dot, an arrow, a bar, a letter, or similar, next to or surrounding the selected option.

According to still another embodiment, the marking of an operator mode in the displayed list on the second display section 16 comprises altering a feature of the typographical setting of the selected option. The altered feature may be e.g. to mark a selected option by presenting the text in bold characters, or by using an enlarged font, or a different colour.

According to another embodiment, the control unit 12 is configured to control the second display section 16 to display an operation view illustrating the procedure of the selected operation mode when the manoeuvring arrangement is in the operation mode. This may relate to information describing the current status of the working equipment related to the selected operation mode, e.g. regarding current capacity utilization or if stabilizer legs are set to ground or not. This will automatically occur if the operator selects an operation mode by allowing the time period to elapse, which will result in that the thus selected operation mode will be applied and the operation view of the selected operation mode will be displayed.

In a further embodiment, the control unit 12 is configured to transmit a signal to the manoeuvring unit 6 to move the marking of an operation mode in the displayed list of the navigation view on the second display section 16 to a neighbouring operation mode in the displayed list of the navigation view on the second display section 16 in response to detecting a signal representing an interaction by the operator with the first selection member 14, provided that no exit selection state signal 20 has been generated. Referring to FIG. 3 showing the navigation view, the marking will move through the displayed list if the operator sequentially presses the first selection member 14 at a rate such that the predetermined time period does not elapse. As an example, if the navigation view initially shows a marking on "CRANE", three "short" activations will move the marking to "BUCKET". If it intended that the operation mode related to "BUCKET" should be applied no more operator activation is required for selecting the bucket operation mode.

According to still another embodiment, the timer module 18 is part of the manoeuvring unit 6, which is illustrated in FIG. 2. As an alternative, the timer module 18 and the control unit 12 are parts of a control system 22 arranged at the working equipment, or at the vehicle where the working equipment is mounted.

In another embodiment, the predefined selection time period is within the range of 0.4-1.2 seconds, preferably within the range of 0.6-1.0 seconds, and more preferred approximately 0.7. The predetermined selection time period may be set by the operator.

According to another embodiment, a second selection member 24, such as a button, is arranged on the manoeuvring unit 6 to receive operator input from the operator regarding a selection of one of the operation modes from a group of predefined operation modes. The control unit 12 is configured to control the second display section 16 of the manoeuvring unit 6 to display the navigation view comprising a list of at least a group of the plurality of predefined operation modes, others than those available by pressing the first selection member 14. Thereby it is enabled to include further selectable operation modes. The procedure of selecting an operation mode in a navigation view activated by the second selection member 24 is the same as the procedure described regarding the navigation view activated by pressing the first selection member 14.

The expression operation mode should be interpreted broadly to include available operation functions of the working equipment and vehicle to which it is mounted. For example in the case of a truck mounted loader crane to include including all possible crane movements, but e.g. also operation modes related to turning on safety lights, controlling stabilizer legs, controlling vehicle engine parameter, moving the truck forward/reverse in very low speed, etc.

Figure 4:
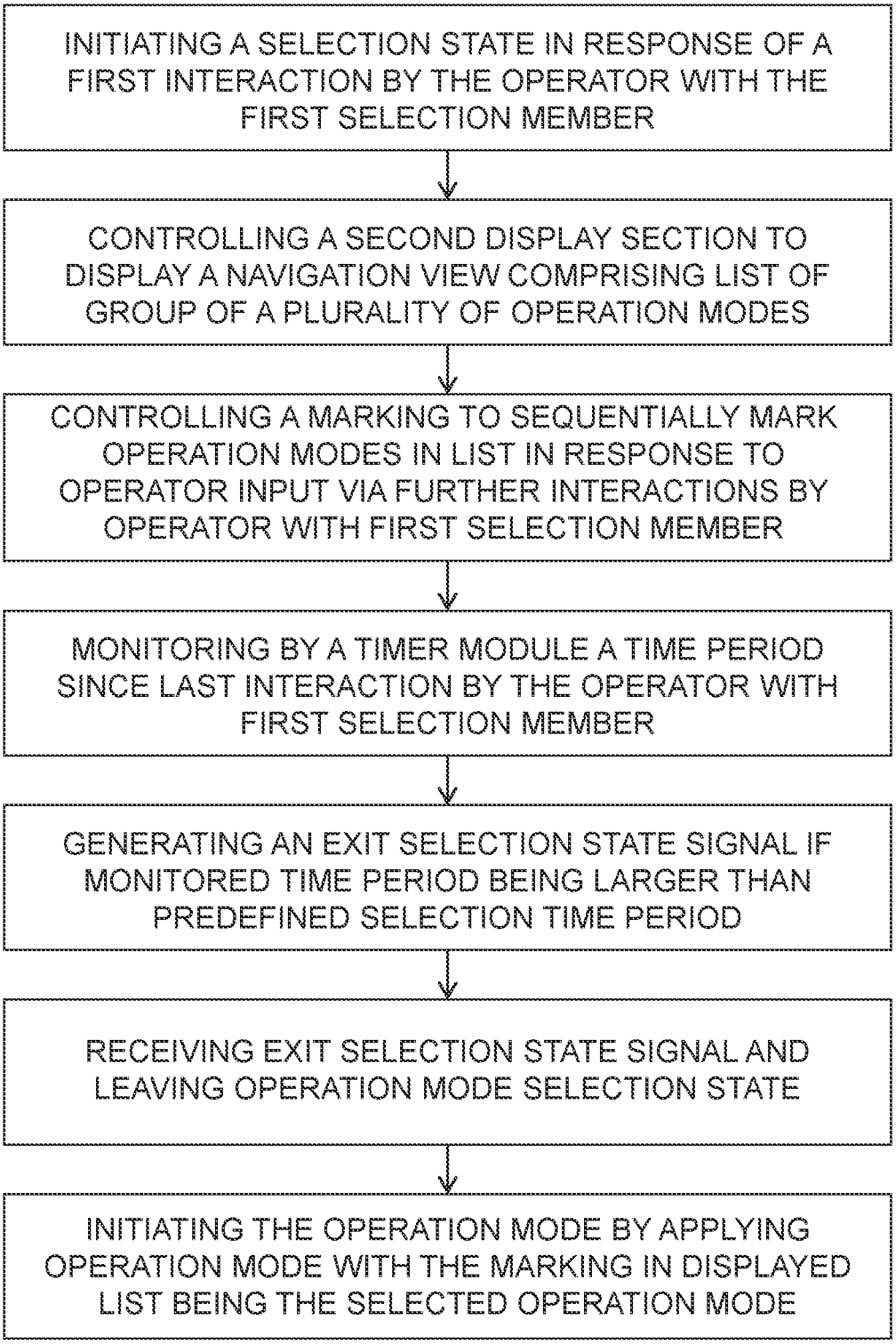
FIG. 4 is a flow diagram showing the method according to the present invention.

The present invention also relates to a method of a manoeuvring arrangement 2, for a working equipment 4. The method is illustrated in the flow diagram shown in FIG. 4. The manoeuvring arrangement has been described in detail above, and it is herein referred to the description above regarding details not discussed in the following.

Thus, the manoeuvring arrangement 2 comprises a manoeuvring unit 6 comprising a set of control members 8 and a first display section 10, and a control unit 12, in wireless and/or wired connection with the manoeuvring unit, and being configured to control an operation of the working equipment in response of operator input from an operator to the manoeuvring unit 6 via the set of control members 8. The control unit is further configured to control the first display section 10 to display graphical instructions of a set of available operation functions mapped to the set of control members 8.

The manoeuvring arrangement 2 is configured to operate in one selected operation mode among a plurality of predefined operation modes, each operation mode having a predefined set of available operation functions mapped to the set of control members 8. The manoeuvring unit 6 further comprises a first selection member 14, such as a button, arranged to receive operator input from the operator regarding a selection of one of the operation modes.

The method comprises:

Initiating a selection state in response of a first interaction by the operator with the first selection member 14.

Controlling, when in the selection state, a second display section 16 of the manoeuvring unit 6 to display a navigation view comprising a list of at least a group of the plurality of predefined operation modes.

Controlling a marking to sequentially mark the operation modes in the displayed list in response to operator input via further interactions by the operator with the first selection member 14.

Monitoring, when in the selection state, by a timer module 18, a time period since the last interaction by the operator with the first selection member 14.

Generating an exit selection state signal 20 in response of the monitored time period being larger than a predefined selection time period.

Receiving the exit selection state signal 20.

Leaving the operation mode selection state.

Initiating the operation mode by applying the operation mode with the marking in the displayed list on the second display section 16 being the selected operation mode.

In the following, some embodiments of the method are listed. These have the same technical features and advantages as for the corresponding features of the manoeuvring arrangement described above. Consequently, these technical features and advantages are not repeated or explained anew in order to avoid unnecessary repetition.

According to an embodiment, the method comprises controlling the first display section 10 to display graphical instructions of the set of available operation functions mapped to the set of control members 8, corresponding to the initiated operation mode in response to leaving the operation mode selection state.

According to another embodiment, the method comprises controlling the first display section 10 to display graphical instructions of the set of available operation functions mapped to the set of control members 8, corresponding to the marked operation mode in response to operator input via further interactions by the operator with the first selection member 14.

In a further variation, the method comprises that the marking of an operator mode in the displayed list on the second display section 16 comprises a graphical symbol, such as a star, a border, a dot, an arrow, a bar, a letter, or similar, next to or surrounding the selected option, or altering a feature of the typographical setting of the selected option.

In still a further embodiment, the method comprises transmitting a signal to the manoeuvring unit 6 to move the marking of an operation mode in the displayed list of the navigation view on the second display section 16 to a neighbouring operation mode in the displayed list of the navigation view on the second display section 16 in response to detecting a signal representing an interaction by the operator with the first selection member 14, provided that no exit selection state signal 20 has been generated.

According to another embodiment, the method comprises that the predefined selection time period is within the range of 0.4-1.2 seconds, preferably within the range of 0.6-1.0 seconds, and more preferred approximately 0.7 seconds.

In another embodiment, the method comprises receiving, on a second selection member 24, operator input from the operator regarding a selection of one of the operation modes from a group of predefined operation modes, and controlling the second display section 16 of the manoeuvring unit 6 to display the navigation view comprising a list of at least a group of the plurality of predefined operation modes, others than those available by pressing the first selection member 14.

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A manoeuvring arrangement, for a working equipment, and comprising:

a manoeuvring unit comprising a set of control members and a first display section, and a control unit, in wireless and/or wired connection with the manoeuvring unit, configured to control an operation of the working equipment in response of operator input from an operator to said manoeuvring unit via the set of control members, and to control the first display section to display graphical instructions of a set of available operation functions mapped to the set of control members, wherein the manoeuvring arrangement is configured to operate in one selected operation mode among a plurality of predefined operation modes, each operation mode having a predefined set of available operation functions mapped to the set of control members, and wherein the manoeuvring unit further comprises a first selection member, such as a button, arranged to receive operator input from the operator regarding a selection of one of the operation modes, wherein the manoeuvring arrangement is configured to initiate a selection state in response of a first interaction by the operator with the first selection member, wherein the control unit is further configured, when in the selection state, to control a second display section of the manoeuvring unit to display a navigation view comprising a list of at least a group of the plurality of predefined operation modes, and to control a marking to sequentially mark the operation modes in the displayed list in response to operator input via further interactions by the operator with the first selection member, and wherein the manoeuvring arrangement further comprises a timer module arranged to monitor the time period since the last interaction by the operator with the first selection member, when in the selection state, and to further generate an exit selection state signal in response of the monitored time period being larger than a predefined selection time period, wherein the control unit is configured to receive said exit selection state signal, and wherein the manoeuvring arrangement is further arranged to leave the operation mode selection state and to initiate the operation mode by applying the operation mode with the marking in the displayed list on the second display section being the selected operation mode, in response to the control unit having received the exit selection state signal.

2. Manoeuvring arrangement according to claim 1, wherein the control unit is further configured to control the first display section to display graphical instructions of the set of available operation functions mapped to the set of control members, corresponding to the initiated operation mode in response to leaving the operation mode selection state.

3. Manoeuvring arrangement according to claim 1, wherein the control unit is further configured to control the first display section to display graphical instructions of the set of available operation functions mapped to the set of control members, corresponding to the marked operation mode in response to operator input via further interactions by the operator with the first selection member.

4. Manoeuvring arrangement according to claim 1, wherein the marking of an operator mode in the displayed list on the second display section comprises a graphical symbol, such as a star, a border, a dot, an arrow, a bar, a letter, or similar, next to or surrounding the selected option, or altering a feature of the typographical setting of the selected option.

5. Manoeuvring arrangement according to claim 1, wherein said control unit is configured to control the second display section to display an operation view illustrating the procedure of the selected operation mode when the manoeuvring arrangement is in the operation mode.

6. Manoeuvring arrangement according to claim 1, wherein the control unit is configured to transmit a signal to the manoeuvring unit to move the marking of an operation mode in the displayed list of the navigation view on the second display section to a neighbouring operation mode in the displayed list of the navigation view on the second display section in response to detecting a signal representing an interaction by the operator with the first selection member, provided that no exit selection state signal has been generated.

7. Manoeuvring arrangement according to claim 1, wherein the timer module is part of the manoeuvring unit, or the timer module and the control unit are parts of a control system arranged at the working equipment.

8. Manoeuvring arrangement according to claim 1, wherein said predefined selection time period is within the range of 0.4-1.2 seconds, preferably within the range of 0.6-1.0 seconds.

9. Manoeuvring arrangement according to claim 1, further comprising a second selection member, such as a button, arranged to receive operator input from the operator regarding a selection of one of the operation modes from a group of predefined operation modes, and that the control unit is configured to control the second display section of the manoeuvring unit to display the navigation view comprising a list of at least a group of the plurality of predefined operation modes, others than those available by pressing the first selection member.

10. The method according to claim 1, comprising receiving, on a second selection member, operator input from the operator regarding a selection of one of the operation modes from a group of predefined operation modes, and controlling the second display section of the manoeuvring unit to display the navigation view comprising a list of at least a group of the plurality of predefined operation modes, others than those available by pressing the first selection member.

11. A method of a manoeuvring arrangement, for a working equipment, the manoeuvring arrangement comprises:

a manoeuvring unit comprising a set of control members and a first display section, and a control unit, in wireless and/or wired connection with the manoeuvring unit, configured to control an operation of the working equipment in response of operator input from an operator to said manoeuvring unit via the set of control members, and, to control the first display section to display graphical instructions of a set of available operation functions mapped to the set of control members, wherein the manoeuvring arrangement is configured to operate in one selected operation mode among a plurality of predefined operation modes, each operation mode having a predefined set of available operation functions mapped to the set of control members, and wherein the manoeuvring unit further comprises a first selection member, such as a button, arranged to receive operator input from the operator regarding a selection of one of the operation modes, characterized in that wherein the method comprises:

initiating a selection state in response of a first interaction by the operator with the first selection member, controlling, when in the selection state, a second display section of the manoeuvring unit to display a navigation view comprising a list of at least a group of the plurality of predefined operation modes, controlling a marking to sequentially mark the operation modes in the displayed list in response to operator input via further interactions by the operator with the first selection member, monitoring, when in the selection state, by a timer module, a time period since the last interaction by the operator with the first selection member, generating an exit selection state signal in response of the monitored time period being larger than a predefined selection time period, receiving said exit selection state signal, leaving the operation mode selection state, and initiating the operation mode by applying the operation mode with the marking in the displayed list on the second display section being the selected operation mode.

12. The method according to claim 11, comprising controlling the first display section to display graphical instructions of the set of available operation functions mapped to the set of control members, corresponding to the initiated operation mode in response to leaving the operation mode selection state.

13. The method according to claim 11, comprising controlling the first display section to display graphical instructions of the set of available operation functions mapped to the set of control members, corresponding to the marked operation mode in response to operator input via further interactions by the operator with the first selection member.

14. The method according to claim 11, comprising transmitting a signal to the manoeuvring unit to move the marking of an operation mode in the displayed list of the navigation view on the second display section to a neighbouring operation mode in the displayed list of the navigation view on the second display section in response to detecting a signal representing an interaction by the operator with the first selection member, provided that no exit selection state signal has been generated.

15. The method according to claim 11, wherein said predefined selection time period is within the range of 0.4-1.2 seconds, preferably within the range of 0.6-1.0 seconds.

* * * * *